United States Patent [19]

Reynolds, Jr. et al.

[11] Patent Number: 4,850,794

[45] Date of Patent: Jul. 25, 1989

[54] HARDFACING TECHNIQUE AND IMPROVED CONSTRUCTION FOR INLET STEAM SEALING SURFACES OF STEAM TURBINES

[75] Inventors: Samuel D. Reynolds, Jr., Oviedo; Narayana S. Cheruvu, Casselberry, both of Fla.

[73] Assignee: Westinghouse Electric Corp., Pittsburgh, Pa.

[21] Appl. No.: 85,583

[22] Filed: Aug. 14, 1987

[51] Int. Cl.[4] ..... F04D 29/12

[52] U.S. Cl. ..... 415/136; 415/232

[58] Field of Search ..... 415/183, 134, 135, 136, 415/128, 126, 219 R; 92/171, 242

[56] References Cited

U.S. PATENT DOCUMENTS

| | | | |
|---|---|---|---|
| 1,625,541 | 4/1927 | Hodgkinson | 415/136 |
| 2,800,299 | 7/1957 | Sheppard et al. | 415/136 |
| 2,863,632 | 12/1958 | Miller | 415/136 |
| 3,476,099 | 11/1969 | Packard et al. | 92/171 X |
| 4,362,464 | 12/1982 | Stock | 415/136 |
| 4,702,671 | 10/1987 | Brinkman et al. | 415/134 |

FOREIGN PATENT DOCUMENTS

| | | | |
|---|---|---|---|
| 58-178806 | 10/1983 | Japan | 415/136 |
| 59-70813 | 4/1984 | Japan | 415/134 |
| 718534 | 11/1954 | United Kingdom | 415/134 |

OTHER PUBLICATIONS

The Condensed Chemical Dictionary, 8th Edition, p. 826, 8/1971.

T. B. Jefferson, et al., *Metals and How to Weld Them*, James F. Lincoln Arc Welding Foundation, cp. 18, Cleveland, OH, Feb., 1983.

*Primary Examiner*—Robert E. Garrett

*Assistant Examiner*—Joseph M. Pitko

[57] ABSTRACT

An improved steam turbine system is provided having a hardfacing disposed on a portion of its steam inlet chamber wear surfaces. The invention also includes a novel stacked ring design having a hardfaced inlet sleeve and stationary, nitride sealing rings for minimizing wear. Also included are novel heat treatments and metallurgical processes for stress relieving these hardfaced components. The techniques and designs employed, decrease steam leakage and assure longer service life for steam powered turbines.

27 Claims, 2 Drawing Sheets

HARDFACING TECHNIQUE AND IMPROVED CONSTRUCTION FOR INLET STEAM SEALING SURFACES OF STEAM TURBINES

FIELD OF THE INVENTION

This invention relates to improving the high temperature oxidation, corrosion, and wear resistance of steam turbine components, and more particularly, to improving the methods and designs for extending the service life of inlet steam sealing surfaces.

BACKGROUND OF THE INVENTION

Steam inlet components for power generating turbines currently suffer from sliding and fretting wear damage during the operation of the turbine. Moreover, temperature cycles of more than 500° F. and the resulting stress create an additional threat of failure of these parts due to thermally induced cracking.

Traditionally, steam inlet components for turbines have included nozzle chambers with pistons or bell seals disposed therein. These components operate in a harsh environment including exposure to high pressure steam, at conditions of about 1100° F. and 3500 psi. Under these conditions, caution must be exercised in selecting materials which provide the necessary metallurgical, physical and mechanical property relationships. The material choices usually involve metals having dissimilar coefficients of expansion, oxidation resistance, corrosion resistance, and high temperature wear resistance. Ultimately, it is desirable to choose a combination of alloys that minimizes the wear of the inlet steam sealing surfaces, while at the same time, providing for satisfactory steam sealing properties.

Metallurgical analysis of selected mating components of the inlet steam chambers, such as, nozzle chamber walls, sealing rings and STELLITE bells, has revealed service induced abrasive and adhesive wear. These pressure retaining parts have also been known to undergo sufficient material loss, resulting in unacceptable steam leakage.

In typical floating piston systems, the nozzle chambers are manufactured using 2.25% Cr, 1% Mo steel (ASTM A182, Gr F22). These systems also include steam sealing rings which are typically made from "REFRACTORY 26" from Carpenter Technology. The pistons of such systems, on the other hand, are usually fabricated from 12% Cr, heat resistant stainless steel (AISI 616), Bethlehem Steel Corp. In conventional bell seal systems, the sealing surfaces include a STELLITE bell against a 2¼% Cr-1% Mo chamber wall. Although selected for their corrosion resistance and steam sealing capabilities, the materials of these systems have been less than optimum in their ability to resist wear and steam leakage during prolonged operation of the turbine.

Careful analysis of the movement of floating piston systems, at the location where the piston comes in contact with the steam inlet chamber of a turbine, has revealed various stages of wear damage. Initially, there is metal to metal friction caused by the rings sliding against the nozzle chamber. Since, at high temperatures, these rings are significantly harder than the nozzle chamber, the sliding results in abrasive wear damage of the nozzle i.e. 2.25% Cr - 1.0% Mo steel, which oxidize. These oxide particles are harder than the surfaces of the rings and the chamber, and accordingly, abrade both surfaces. As the wear mechanism progresses, there occurs a continuous oxidation of fresh surfaces.

In addition to this mechanism, adhesive wear also occurs at the contact point between the chamber and the rings of floating piston systems. Occasionally, during the operation of the steam turbine, two clean ring and chamber surfaces come into contact due to breakage of the protective oxide film in local areas of these components. When the applied stresses at these contact areas exceed a critical value, cold welding, or adhesive wear, can occur at the contact junction. If this condition is left to develop further, the resulting sheer stresses can cause the delamination of one of the materials at the contact surface. Since the 2.25% Cr - 1.0% Mo steel is relatively soft, the nozzle surface transfers metal to the relatively hard ring surfaces. Any tilt or twist in the rings or lack of a complete contact between a ring and the nozzle chamber can significantly accelerate the deterioration of the steam inlet components.

Similar wear related problems have also been found in the bell seal design, where the harder STELLITE bell sealing surface wears the 2¼% Cr-1% Mo interior wall of the steam chamber.

Replacement of worn, fretted, or cracked components can be extremely costly. Down-time alone can amount to hundreds of thousands of dollars per day, since an electric utility must buy electrical power elsewhere to meet consumer demands. In addition to this cost, the expenses associated with hiring a repair crew and purchasing and storing spare parts can be significant.

Accordingly, there is still a need for a material combination and steam chamber design that minimizes sliding and fretting wear of inlet steam sealing surfaces. There is also a need for extending the useful life of nozzle chambers to minimize down-time of the steam turbine.

SUMMARY OF THE INVENTION

A hardfacing technique and improved construction for inlet steam sealing surfaces of power generating steam turbines are provided. Specifically, the wear properties of turbine inlet steam surfaces are improved by using a eutectic hardened cobalt based hardfacing on surfaces particularly affected by adhesive or abrasive wear. These hardface surfaces can be further thermally treated to restore the ductility and creep properties of the base metal in the heat-affected zone.

Also provided by this invention is a novel steam turbine system having an inlet sleeve disposed within a "stacked" ring configuration. The inlet sleeve of this invention has a channel therethrough for receiving steam and ring sealing means for sealing this steam. The ring sealing means is disposed in sliding contact with an external wall of the inlet sleeve. The ring sealing means slides against a hardfacing layer disposed on at least the portion of the inlet sleeve wall which is in sliding contact with the ring sealing means.

The hardfacing technique used herein is also applicable to known bell seal and floating piston inlet steam chamber designs. In the floating piston type nozzle chamber of this invention, a hardfacing layer is disposed on the internal wall of the nozzle chamber for protecting the nozzle chamber from wear by the relatively hard sealing rings. In the bell seal design, a hardfacing layer is disposed on at least a portion of the internal wall of the chamber which is in contact with a rim portion of the bell sealing means. Since many existing nozzles of these designs are currently in service and cannot easily be hardfaced using conventional welding techniques, this invention anticipates that a hardfaced sleeve can be inserted inside the nozzle chambers to protect the existing chamber from wear damage.

The invention also includes a preferred processing sequence which includes Plasma Transferred Arc welding procedures combined with stress relieving, normalizing and tempering heat treatments. The latter operations provide a proof test of the thermal shock resistance of the hardfacing deposit and restore ductility and creep strength to the heat affected zone of the preferred 2¼% Cr - 1% Mo components for resisting premature failure and thermal shock damage.

Accordingly, this invention provides a material combination, construction and process that minimizes sliding friction and fretting wear of inlet steam sealing surfaces. The techniques and procedures discussed herein increase corrosion and oxidation resistance of the inlet steam nozzle chambers, reduce down time of steam turbines, and provide a cost savings to power generating operations.

It is, therefore, an object of this invention to provide an improvement to inlet steam nozzle chambers to minimize wear of their mating surfaces.

It is still another object of this invention to provide a method for restoring the base metal properties of a hardfaced inlet chamber, while at the same time, thermal shock proof testing the chamber prior to use.

It is still another object of this invention to provide a novel inlet steam chamber design for minimizing wear at elevated temperatures.

With these and other objects in view, which will become apparent to one skilled in the art as the description proceeds, this invention resides in the novel construction, combination, arrangement of parts and methods substantially as hereinafter described and more particularly defined by the attached claims.

BRIEF DESCRIPTION OF THE DRAWINGS

The accompanying drawings illustrate two embodiments of the invention according to the best mode so far known for the practical application of the principles thereof, and in which.

DETAILED DESCRIPTION OF THE INVENTION

The present invention provides improved steam turbine systems of the type having inlet steam nozzle chambers. The useful life of these systems is improved by disposing a hardfacing layer of a eutectic hardened alloy, preferably TRIBALOY-400, available from Stoody-Deloro-STELLITE Inc. San Diego, Calif. This material is provided on one or more of the mating surfaces of the inlet steam chamber.

In one embodiment of this invention a steam turbine system is provided having a steam nozzle chamber with a piston arranged for reciprocal movement therein and a ring member for sealing pressurized steam. The ring member of this invention has an inner diameter for engaging the piston and an outer diameter disposed in sliding contact with an internal wall of the nozzle chamber. In this embodiment, a hardfacing layer or sleeve is disposed on at least a portion of the internal wall of the chamber which is in contact with the ring member. This design minimizes the nozzle chamber wear caused by sliding friction contact with the relatively hard ring members.

In another steam turbine system embodiment of this invention, conventional bell sealing means is provided with a hardfacing layer or sleeve disposed on at least a portion of the internal wall of the nozzle chamber which is in contact with the sealing rim portion of the bell sealing means. Typically, the bell is made with STELLITE to provide a proper coefficient of expansion and to ensure longer wear life. Since STELLITE is a relatively hard alloy, hardfacing the nozzle chamber will promote a longer service life for the steam sealing surfaces.

In still another embodiment of this invention, a steam turbine system having a novel inlet steam nozzle construction is provided. This construction includes an inlet sleeve having a channel therethrough for receiving steam, and ring sealing means for sealing steam. According to this embodiment, the ring sealing means is disposed in sliding contact with an external wall of the inlet sleeve. The ring sealing means preferably is stationary, and more preferably, comprises a plurality of sealing rings separated by a plurality of spacing members. Further according to this embodiment, a hardfacing layer is disposed on at least a portion of the inlet sleeve external wall which is in sliding contact with the ring sealing means.

Figure 1:
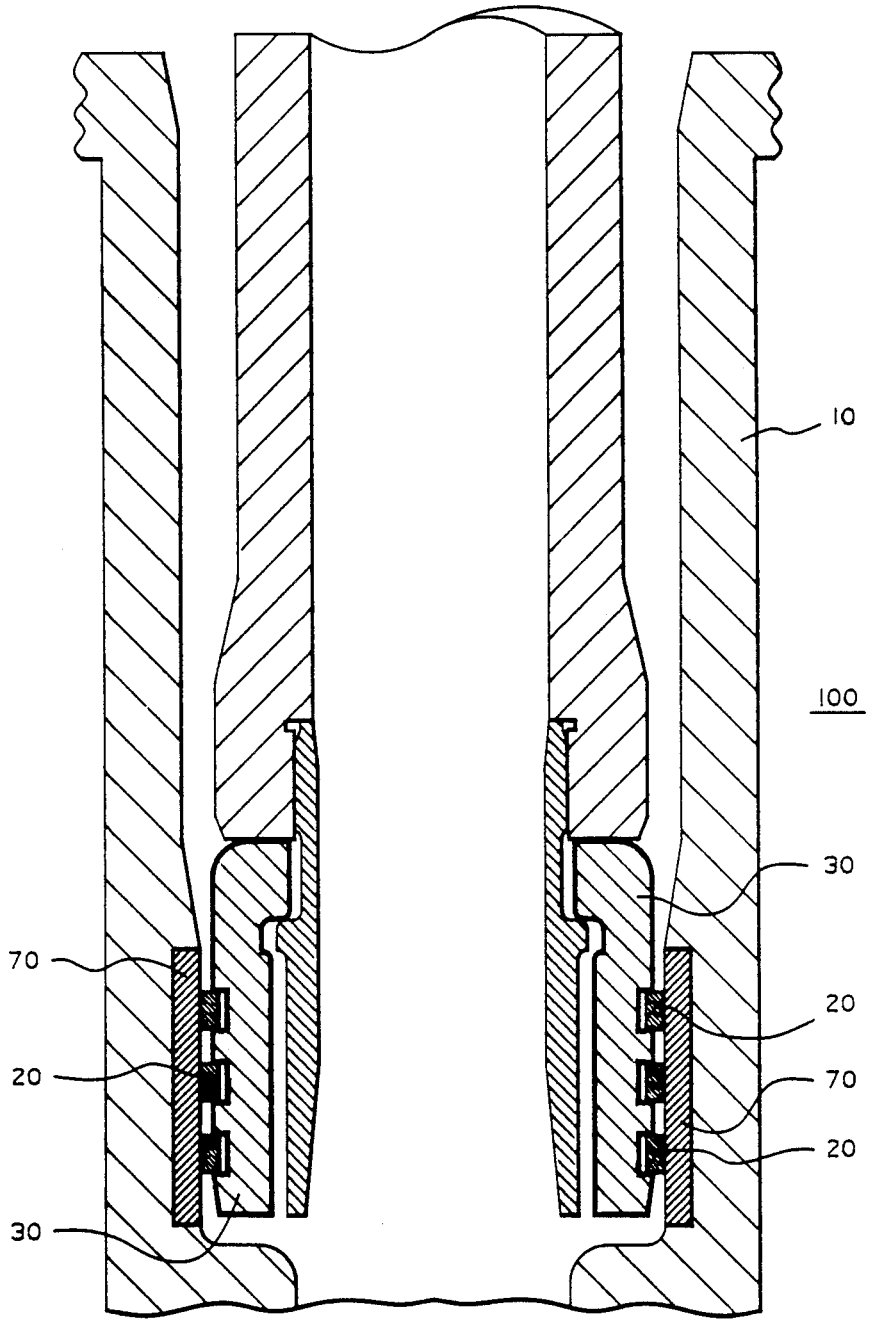
FIG. 1: is a cross-sectional view of a floating piston nozzle chamber illustrating a piston, a plurality of pressure sealing rings, and a hardfacing layer deposited on a portion of the inner wall of the nozzle chamber.
Figure 2:
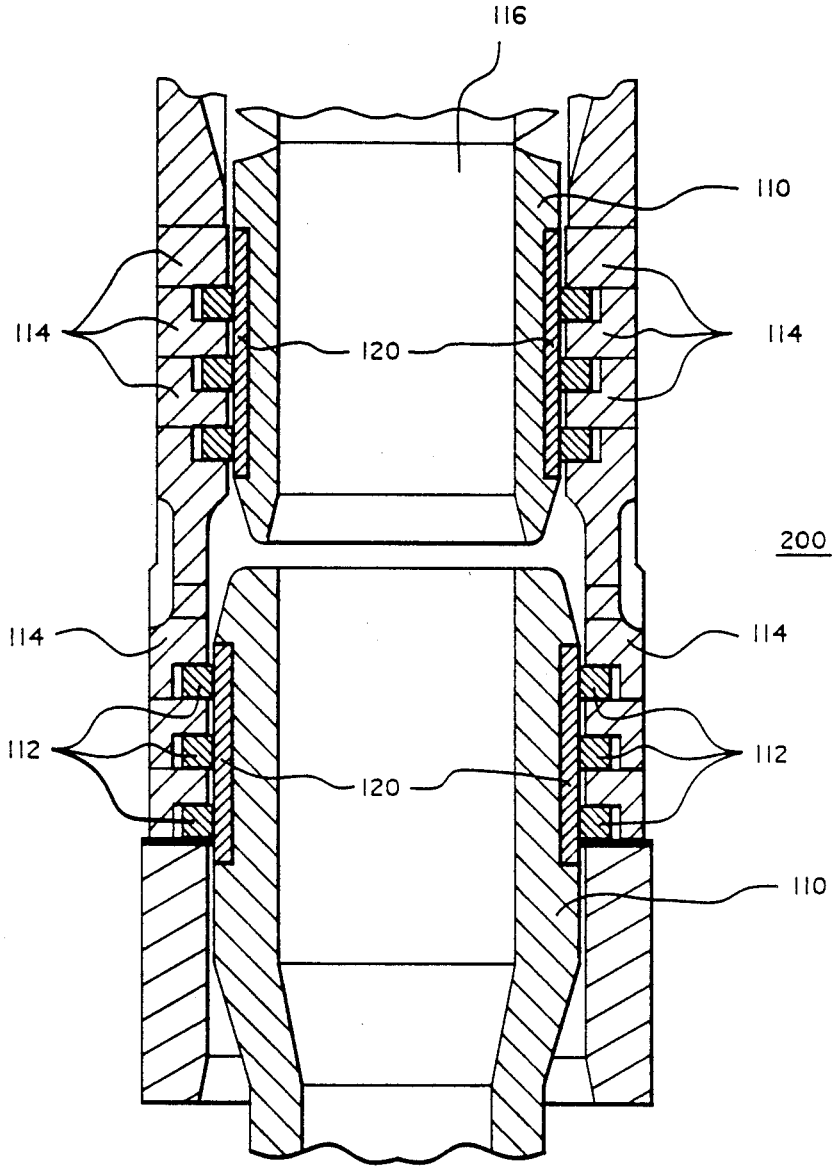
FIG. 2: is a cross-sectional view of a stacked ring nozzle chamber illustrating a hard surfacing layer disposed on the inlet sleeves and a plurality of steam sealing rings and spacer members.

Referring now to FIG. 2, there is shown a cross-sectional view of a stacked-ring nozzle chamber assembly 200 comprising an inlet sleeve 110 having a channel 116 therethrough for receiving steam. This assembly further includes ring sealing means disposed in sliding contact with an external wall of the inlet sleeve 110. This novel system differs from the floating piston system of FIG. 1, in that the sealing rings 112 are fixed, rather than slidably disposed within the chamber.

As used herein, the term "hardfacing layer" refers to a layer of metal deposited onto the base metal to provide a surface which is harder and more wear resistant than the softer base metal. Also as used herein, the term "hard surface" refers to hardfacing, as defined, in combination with other metallurgical treatments that provide a hard surface finish to a base metal, for example, heat treating, surface alloying, and nitrating.

Referring now to the drawings, and in particular to FIG. 1, there is shown a cross-sectional view of a preferred floating piston nozzle chamber assembly 100 having disposed therein a piston 30 arranged for reciprocal movement within said nozzle chamber 10 and at least one ring member 20 for sealing pressurized steam. The ring member (or members) 20 has an inner diameter for engaging the piston 30 and an outer diameter disposed in sliding contact with an internal wall of the nozzle chamber 10. One object of this embodiment is to provide the improvement whereby a hardfacing layer 70 is disposed on at least the portion of the internal wall of the chamber 10 which is in contact with the ring member 20.

Referring now to FIG. 2, there is shown a cross-sectional view of a stacked-ring nozzle chamber assembly 200 comprising an inlet sleeve 110 having a channel 116 therethrough for receiving steam. This assembly further includes ring sealing means 112 disposed in sliding contact with an external wall of the inlet sleeve 110. This novel system differs from the floating piston system of FIG. 1, in that the sealing rings II2 are fixed relative to the chamber rather than slidably disposed within the chamber.

The stacked ring configuration 200 of FIG. 2 preferably comprises a plurality of sealing rings 112 separated by a plurality of spacing members 114. The stacking of the rings 112 and spacing members 114 forms a housing around the inlet sleeve 110 much like the nozzle chamber 10 of the floating piston design 100. In a preferred embodiment of the stacked ring design, a hardfacing layer, preferably containing cobalt, and more preferably containing TRIBALOY-400, is disposed on at least the portion of the external wall 120 of the inlet sleeve which is in sliding contact with the ring sealing means.

The nozzle chamber 10 for the floating piston system 100, the nozzle chamber for the conventional bell-seal design and the inlet sleeve 110 of the stacked ring design, 200 are preferably made of a steel comprising Cr and Mo. The most preferred material for these components is a steel forging made of 2.25 weight percent Cr and 1.0 weight percent Mo (ASTM A 182, Gr F22). This material is selected because of its oxidation resistance, creep strength, and resistance to thermal shock at operating temperatures up to about 566° C. The coefficient of thermal expansion of this material is $7.5\times10^{-6}$ in./in.-° F. (R.T.-1000° F.).

In an important aspect of this invention, a hardfacing layer is disposed on at least the portion of the wear surfaces of each of the enumerated designs. In the preferred floating piston system 100 of FIG. 1 the hardfacing layer 70 (or hardface sleeve, as in the case where such designs are already in service) can be applied to the inner diameter of the pressure nozzle chamber 10. In the conventional bell seal design, a hardfacing layer or sleeve can be applied to the chamber in the area where the sealing rim of the STELLITE bell slides against the inner wall. Finally, in the stacked ring design 200 of FIG. 2, a hardfacing deposit 120 is preferably applied on the outer diameter of the inlet sleeve (or sleeves) 110. It is anticipated that the hardfacing layer of the embodiments may be disposed by any of the known welding techniques including, for example, Plasma Transferred Arc, Shielded Metal Arc, Gas Metal Arc or Gas Tungsten Arc procedures.

With particular reference to the application of this invention to nozzles already in service, a steel sleeve having a deposited hardfacing component on its interior can be inserted within the chamber; or a steel sleeve having a deposited hardsurface component on its exterior surface can be inserted around the inlet sleeve, for introducing a wear resistent surface. This sleeve can be pressure fitted or welded, for example, to adhere it to the surface that is being protected. This procedure is preferred as an "on-site" repair procedure, since the close confines of the nozzle chamber in the floating piston and bell designs make conventional welding techniques difficult.

The hardfacing layer generally comprises any of the known hardfacing materials, for example, tungsten carbides, chromium carbides, semi-austenitic alloys including chromium, austenitic manganese, etc. Preferably the hardfacing layer comprises cobalt, and most preferably, the hardfacing layer comprises TRIBALOY-400. This latter material consists essentially of about 0.08 weight percent C (maximum), 2.6 weight percent Si, 8.5 weight percent Cr, 28.5 weight percent Mo, 3.0 weight percent Ni and Fe (maximum), and balance Co. It should be understood that this composition represents ideal weight percentages within a range provided by its manufacturer for each elemental constituent, so variations of the composition will also be acceptable assuming physical properties are substantially metalized. This material possesses a Rockwell "C" hardness of about 51 to 58 and a mean coefficient of thermal expansion of about $7.5\times10^{-6}$ in./in.-° F. (Room temperature to 1500° F.).

When the hardfacing layer comprises TRIBALOY-400 material, the welding usually is proceeded with a high preheat temperature to prevent hot cracking of the TRIBALOY-400 weld deposit. These high preheat temperatures can result in the formation of detrimental metallurgical structures in the "heat affected zone" of the base metal and therefore require the use of careful welding procedures and post-heat treatment processes. As used herein, the "heat affected zone" refers to the portion of the chamber or the inlet sleeve nearest to the welded deposit that undergoes a metallurgical change due to welding temperatures. In order to overcome this problem, this invention anticipates the use of a Plasma Transferred Arc process for depositing the TRIBALOY-400 material on the preferred 2.25% Cr - 1.0% Mo nozzle chamber base metal. A Plasma deposition process is compatible with powdered filler metal and produces a high strength metallurgical bond with a minimal "heat affected zone", resulting in a more ductile nozzle chamber 10.

One successful Plasma Transferred Arc technique uses a prealloyed controlled mesh size atomized powder form of TRIBALOY-400. The nozzle chamber or inlet sleeve is preheated to 1050° F. and kept at an interpass temperature of 1200° F. max. A shield gas of 95% Argon and 5% helium is recommended at a flow rate of 45±5 cubic feet per hour.

The hardfacing layer is preferably deposited in a thickness of about 4.8 mm to 5.9 mm, more preferably in a thickness of about 5.0 mm-5.5 mm, and most preferably about 5.3 mm. To ultimately obtain the desired thickness no matter which welding procedure is used to deposit the hardfacing layer, machining may be required.

Upon completion of the hardfacing deposition, the chamber or inlet sleeve (with its deposited hardfacing layer) is preferably heat treated to lower residual stresses created by the welding operation. This stress relief heat treatment, preferably performed immediately, should be conducted at about 666° C. to 694° C., preferably about 680° C. This temperature should be held for about one to four hours, most preferably about two hours. In the conduct of this heat treatment, heating and cooling rates should be controlled to be less than about 38° C. per hour. After this step, the part can be machined to desired tolerances.

After rough machining, the part is preferably given a normalizing treatment with austenization for a minimum of one hour per inch of chamber thickness at a temperature of about 846° C. to 874° C., preferably about 860° C. "Normalizing", as used herein, refers to the process wherein a steel is heat treated to a temperature sufficient to transform the microstructure into austenite, followed by cooling, preferably air cooling. The heating rate during normalizing should also be about 38° C. per hour or less. Following this treatment, the part should be cooled, preferably in still air, from the austenitizing temperature. An air cool is preferred since it tends to produce the desired structure in the heat affected zone. Moreover, cooling in air closely approximates the rapid cooling that inlet steam chambers experience in the turbine environment. Accordingly, this relatively fast cool provides a shock test for the chamber prior to actual service.

Further according to this invention, the normalized nozzle chamber or inlet sleeve is subject to a tempering operation wherein the chamber or inlet sleeve, and associated hardfacing layer 70 or 120, are heated to a temperature of about 660° C. to 694° C., preferably about 680° C., with heating and cooling rates of up to about 38° C. per hour. Tempering has the effect of transforming deleterious metallurgical structures in the preferred steel chamber into structures which will perform in a predictable manner at high temperatures. It is permissible to cool this tempering temperature at rates exceeding about 38° C. per hour when the chamber reaches a temperature below about 260° C.

The detailed heat treatment schedules that are provided by this invention are designed to reduce the brittle Heat Affected Zone caused by welding. The high temperature hardfacing operation can produce ferrite on grain boundaries, which in turn can result in poor ductility. If not remedied, this condition can lead to cracking of the base metal and premature failure of the nozzle chamber or inlet sleeve. The heat treatment schedules herein provided reaustenitize the brittle ferrite phase, temper the steel to a more ductile phase, and produce a more creep resistant and crack resistant nozzle chamber or inlet sleeve. These are important features of this invention since the nozzle chamber and component parts are exposed to pressurized steam, which can provide pressure of 3,500 psi with cyclical temperatures that can reach 1100° F. Moreover, these features protect the chamber from the effects of thermal shock during start ups and shut downs.

The ring members (or pressure sealing rings) 20 of the floating piston design, are preferably made from heat resistant alloy, most preferably an alloy having a hardness of about 26.0 to 35.5 Rockwell "C". One material that has been employed with some success has been REFRACTALOY 26, Carpenter Technology, Monroe, NC. This material has a coefficient of thermal expansion of about $8.2\times10^{-6}$ in./in.-° F. (R.T.-1000° F.). The composition of this preferred ring member material consists essentially of about 35.0 to 39.0 weight percent Ni, 18.0 to 22.0 weight percent Co, 16.0 to 20.0 weight percent Cr, 2.5 to 3.0 weight percent Ti, 2.5 to 3.5 weight percent Mo, 0.001 to 0.01 weight percent B, 0.0 to 1.5 weight percent Si, 0.0 to 1.0 weight percent Mn, 0.0 to 0.25 weight percent Al, 0.0 to 0.8 weight percent C, 0.0 to 0.03 weight percent P, 0.0 to 0.03 weight percent S, and the balance being Fe.

For the stacked ring embodiment 200. the rings 112 are stationary with respect to the inlet sleeve and are positioned against the external diameter of the inlet sleeve 110. Preferably these rings are made from a modified 12% Cr Stainless steel with a Malcomized (nitrided) surface. This material is selected because of its coefficient of expansion and high temperature properties. Generally, stainless steels of this chrome content contain no nickel and are frequently called martensitic stainless steels. However, the hardness of a martensitic steel will greatly depend on the carbon content, a high carbon content tending to produce a harder structure. Such steels are generally assumed to be heat treatable and comprise the stainless steel specification numbers AISI 403, AISI 410, AISI 414, AISI 416, AISI 418 special, AISI 420, AISI 420 Se, AISI 431, AISI 440 A, AISI 440 B, AISI 440 C, and AISI 440 Se and AISI 616. The basic type used in the manufacture of turbine components, such as the piston 30 of this invention, is AISI 616 which has a chromium content of about 12%. These materials, because of their alloy balance, are capable of hardening intensely after exposure to austenitizing temperatures, even with an air cool, and unless precautions are taken, they can crack because of the high hardness developed. Preheating these steels, however, can lower thermal differences, and allowing the steel to cool slowly will further reduce the cracking tendencies.

This invention also provides selected 12% chromium steel components of the stacked ring system 200, with a wear resistant hardface. Stainless steel is readily worn by harder materials, such as oxidized metal particles and TRIBALOY-400 coated surfaces. Accordingly, by providing a hardened surface on the preferred 12% chromium steel rings 12 of the stacked ring chamber 200. these components can more ably resist abrasive and frictional wear. In similar fashion, the preferred 12% chromium steel piston 30 of the floating piston system 100 can also be protected, although this is not required. Although hardfacing welding techniques can be used to harden the rings 112 of the stacked ring design, a more preferred procedure includes diffusion hardening, which may include, for example, carburizing, cyaniding, carbonitriding, induction hardening, flame hardening and nitriding. The most preferred diffusion hardening technique, however, is nitriding.

The preferred nitriding cycle of this invention should be conducted at about 1025° F. to 1050° F. for a minimum of about 25 hours. It is understood that this temperature and duration can be varied, if necessary, to obtain the required surface hardness range and case hardness depth. As used herein, the "case hardness depth" refers to an outer portion of a ferrous alloy article which has been hardened so that it is substantially harder than the inner portion, or core. The most preferred case depth for this nitriding procedure is about 0.15 mm to about 0.30 mm, with a superficial hardness measurement on the Rockwell 15 N scale of about 90 to 96 on the nitrated surfaces. The superficial hardness readings should be determined in accordance with ASTM E-18.

Nitriding is a procedure well known to those in the metallurgical industry and is generally conducted in molten cyanide baths at relatively low temperatures of about 500° to 570° C. The nitriding bath can comprise 60 to 70% NaCN, along with minor amounts of one or more of $Na_2C0_3$, NaCNO KCN, $K_2CO_3$, KCNO and KCl. Nitriding improves the wear resistance and fatigue resistance of the sealing rings 112.

Alternatively, a gas nitriding procedure can be used. This procedure involves diffusing nitrogen into the 12% Cr alloy from an ammonia containing atmosphere. In such a procedure, quenching is not required, and the temperature can range from about 500° to 570° C. Because of the chromium alloying additions, the preferred stainless steel materials for the rings 112 provide for more stable nitrides and produce a nitrated case hardness having excellent wear resistance.

In summary, this invention provides improvements to the inlet steam nozzle chambers of a conventional steam turbine system. The addition of a preferred TRIBALOY-400 hardfacing on the 2.25% Cr - 1.0% Mo steel nozzle chambers and inlet sleeve of this invention greatly improves their wear resistance in the hot steam environment as demonstrated by laboratory wear tests. As described above, the coefficients of thermal expansion for the TRIBALOY-400 and 2.25% Cr - 1.0% Mo base metals are similar, which minimizes thermal stresses of the components as the nozzle unit expands at steam temperatures of about 538° C. The surface preparations for the nozzle chamber and inlet sleeve bring the surfaces of these components into a hardness range that more closely approximates the hardness of the other components, and thus, abrasive and adhesive wear can be minimized. The heat treatment schedules provided by this invention restore the ductility to the heat affected zone of the welded steel member of this invention. Finally, the above-enumerated fast cool from normalizing temperatures provides a proof test of the thermal shock resistance of the hardfacing deposit prior to use.

From the foregoing, it can be realized that this invention provides an improved inlet steam nozzle chamber assemblies for resisting wear at steam turbine operating conditions. Accordingly, this invention provides a longer lasting turbine system and a cost savings to operators of power- generating equipment. Although various embodiments have been illustrated, this was for the purpose of describing, not limiting the invention. Various modifications, which will become apparent to one skilled in the art, are within the scope of this invention.

We claim as our invention:

1. A steam turbine system of the kind having an inlet steam nozzle chamber, said chamber having a piston arranged for reciprocal movement therein and a ring member for sealing pressurized steam, said ring member having an inner diameter which engages said piston and an outer diameter disposed in sliding contact with an internal wall of said nozzle chamber, said outer diameter of said ring member having a hard surface thereon, wherein said internal wall comprises a hardfacing layer disposed on at least the portion of said internal wall which is in contact with said ring member, said hardfacing layer having a $R_c$ hardness of about 51–58 and a coefficient of thermal expansion which is about that of the nozzle chamber above about 538° C.

2. The system of claim 1 wherein said hardfacing layer comprises a hardfaced sleeve.

3. The system of claim 1 wherein said hardfacing layer consists essentially of about 0.0 to .08 weight percent C, 2.6 weight percent Si, 8.5 weight percent Cr, 28.5 percent Mo, 0.0 to 3.0 weight percent Ni and Fe, and the balance being Co.

4. The system of claim 1 wherein said hardfacing layer is disposed in a thickness of about 4.8 mm to 5.9 mm.

5. The system of claim 1 wherein said hardfacing layer is disposed in a thickness of about 5.3 mm.

6. The system of claim 1 wherein said chamber comprises steel.

7. The system of claim 6 wherein said steel comprises Cr and Mo.

8. The system of claim 6 wherein said steel comprises 2.25 weight percent Cr and 1.0 weight percent Mo.

9. The system of claim 6 wherein said chamber comprises a forging.

10. The system of claim 1 wherein said ring member has a hardness of about 26.0 to 35.5 Rockwell "C".

11. The system of claim 10 wherein said ring member consists essentially of about 35.0 to 39.0 weight percent Ni, 18.0 to 22.0 weight percent Co, 16.0 to 20.0 weight percent Cr, 2.5 to 3.0 weight percent Ti, 2.5 to 3.5 weight percent Mo, 0.001 to 0.01 weight percent B, 0.0 to 1.5 weight percent Si, 0.0 to 1.0 weight percent Mn, 0.0 to 0.25 weight percent Al, 0.0 to 0.08 weight percent C, 0.0 to 0.03 weight percent P, 0.0 to 0.03 weight percent S, and the balance being Fe.

12. The system of claim 1 wherein said pressurized steam comprises steam at a pressure of 3,500 psi, said steam having a temperature of about 538° C.

13. The system of claim 1 wherein said piston comprises 8 to 16 weight percent chromium.

14. The system of claim 1 wherein said piston comprises about 12 weight percent chromium.

15. The system of claim 14 wherein said piston comprises martensitic stainless steel.

16. The system of claim 1 wherein said piston comprises a hard surface having a case hardness depth of about 0.15 mm to 0.30 mm.

17. The system of claim 1 wherein said hard surface comprises a nitrided surface.

18. A steam turbine system of the type having an inlet steam nozzle chamber, said chamber having a bell sealing means arranged for reciprocal movement therein, said bell sealing means having a hard alloy rim portion disposed in sliding contact with an internal wall of said nozzle chamber for sealing pressurized steam, said system comprising a hardfacing layer disposed on at least the portion of said internal wall of said chamber which is in contact with said rim portion; said hardfacing layer having an $R_c$ hardness of about 51–58 and a coefficient of thermal expansion which is about that of the nozzle chamber of about 538° C.

19. The system of claim 18 wherein said hardfacing layer comprises a hardfaced sleeve.

20. The system of claim 18 wherein said hardfacing layer consists essentially of about 0.0 to 0.08 weight percent C, 2.6 weight percent Si, 8.5 weight percent Cr, 28.5 percent Mo, 0.0 to 3.0 weight percent Ni and Fe, and the balance being Co.

21. The system of claim 18 wherein said hardfacing layer is disposed in a thickness of about 4.8 mm to 5.9 mm.

22. The system of claim 18 wherein said hardfacing layer is disposed in a thickness of about 5.3 mm.

23. A steam turbine system of the type having an inlet steam nozzle chamber, wherein said chamber comprises:

a. an inlet sleeve having a channel therethrough for receiving steam; and b. ring sealing means for sealing steam, said ring sealing means disposed in sliding contact with an external wall of said inlet sleeve; said ring sealing means comprising a plurality of sealing rings separated by a plurality of spacing members, said rings and spacing members forming a housing for said inlet sleeve; said inlet sleeve further comprising a hardfacing layer disposed on at least the portion of its external wall which is in sliding contact with said ring sealing means; said hardfacing layer having a $R_c$ hardness of about 51–58 and a coefficient of thermal expansion which is about that of the nozzle chamber above about 538° C.

24. The system of claim 23 wherein said hardfacing layer comprises cobalt.

25. The system of claim 23 wherein said hardfacing layer consists essentially of about 0.08 weight percent C maximum, 2.6 weight percent Si, 8.5 weight percent Cr, 28.5 percent Mo, 3.0 weight percent Ni and Fe maximum, and the balance being Co.

26. The system of claim 23 wherein said hardfacing layer is disposed in a thickness of about 4.8 mm to 5.9 mm.

27. The system of claim 23 wherein said hardfacing layer is disposed in a thickness of about 5.3 mm.

* * * * *